US008087525B2

(12) United States Patent
Kelley et al.

(10) Patent No.: US 8,087,525 B2
(45) Date of Patent: Jan. 3, 2012

(54) MULTI-PANEL PLASTIC CONTAINER

(75) Inventors: Paul Kelley, Wrightsville, PA (US); Scott Bysick, Lancaster, PA (US); Justin Howell, New Cumberland, PA (US)

(73) Assignee: Graham Packaging Company, L.P., York, PA (US)

( * ) Notice: Subject to any disclaimer, the term of this patent is extended or adjusted under 35 U.S.C. 154(b) by 323 days.

(21) Appl. No.: 11/529,486

(22) Filed: Sep. 29, 2006

(65) Prior Publication Data

US 2007/0075032 A1 Apr. 5, 2007

Related U.S. Application Data

(60) Provisional application No. 60/722,043, filed on Sep. 30, 2005.

(51) Int. Cl.
*B65D 90/02* (2006.01)

(52) U.S. Cl. ..... 215/379; 215/381; 215/382; 215/384; 220/608; 220/675; 220/771

(58) Field of Classification Search ..... 215/379, 215/381, 382, 384; 220/608, 675, 771
See application file for complete search history.

(56) References Cited

U.S. PATENT DOCUMENTS

| | | | |
|---|---|---|---|
| D191,069 | S | 8/1961 | Schacher |
| 3,536,500 | A | 10/1970 | Cleereman et al. |
| D234,911 | S | 4/1975 | Stevens, Jr. |
| D263,026 | S | 2/1982 | Beechuk et al. |
| 4,805,788 | A | 2/1989 | Akiho |
| 4,946,053 | A | 8/1990 | Conrad |
| 5,092,474 | A | 3/1992 | Leigner |
| 5,101,990 | A | 4/1992 | Krishnakumar et al. |
| D335,455 | S | 5/1993 | Brown |
| 5,226,538 | A | 7/1993 | Roselle |
| 5,303,834 | A | 4/1994 | Krishnakumar et al. |
| 5,330,054 | A | 7/1994 | Brown |
| 5,472,105 | A | 12/1995 | Krishnakumar et al. |
| 5,690,244 | A | 11/1997 | Darr |
| D399,391 | S | 10/1998 | Malvasi et al. |
| 5,971,184 | A | 10/1999 | Krishnakumar et al. |

(Continued)

FOREIGN PATENT DOCUMENTS

| | | | |
|---|---|---|---|
| EP | 1 431 190 | A | 6/2004 |

(Continued)

OTHER PUBLICATIONS

"And Constar Makes Three in the Hot-Fill, Panel-Less Bottle Race Packaging Strategies," Aug. 31, 2005, p. 5, (www.packstrat.com).

*Primary Examiner* — Anthony Stashick
*Assistant Examiner* — Elizabeth Volz
(74) *Attorney, Agent, or Firm* — Knoble Yoshida & Dunleavy, LLC

(57) ABSTRACT

A container adapted to increase volume contraction and reduce pressure having four panels that are adapted to contract inwardly from vacuum forces created by contraction of container contents. The container has a sidewall including four panels. The four panels are vacuum panels, including vertical transitional walls disposed between and joining the panels and the body is adapted to increase volume contraction and reduce pressure. The panels are adapted to contract inwardly in response to internal negative pressure created during hot-fill processing and subsequent cooling of a hot liquid in the container.

24 Claims, 16 Drawing Sheets

U.S. PATENT DOCUMENTS

| | | | | |
|---|---|---|---|---|
| 6,044,996 | A | 4/2000 | Carew et al. | |
| D435,453 | S | 12/2000 | Krishnakumar et al. | |
| D436,042 | S | 1/2001 | Krishnakumar et al. | |
| D436,043 | S | 1/2001 | Krishnakumar et al. | |
| D442,492 | S | 5/2001 | Krishnakumar et al. | |
| D446,730 | S | 8/2001 | Adee et al. | |
| D462,273 | S | 9/2002 | Crawford | |
| D466,414 | S | 12/2002 | Venkataraman et al. | |
| 6,513,669 | B2 | 2/2003 | Ozawa et al. | |
| 6,637,613 | B2 | 10/2003 | Shimada et al. | |
| D482,976 | S | 12/2003 | Melrose | |
| 6,739,467 | B2 | 5/2004 | Saito et al. | |
| 6,837,390 | B2 | 1/2005 | Lane et al. | |
| 6,920,992 | B2 | 7/2005 | Lane et al. | |
| 6,935,525 | B2 * | 8/2005 | Trude | 215/381 |
| 7,014,056 | B2 | 3/2006 | Trude | |
| D525,529 | S | 7/2006 | Oguchi et al. | |
| 7,073,675 | B2 | 7/2006 | Trude | |
| 7,137,520 | B1 | 11/2006 | Melrose | |
| D533,785 | S | 12/2006 | Corbett et al. | |
| D536,255 | S | 2/2007 | Corbett et al. | |
| 7,191,910 | B2 | 3/2007 | Deemer et al. | |
| D542,666 | S | 5/2007 | Trude | |
| 7,213,719 | B2 | 5/2007 | Pedmo et al. | |
| D547,664 | S * | 7/2007 | Davis et al. | D9/538 |
| 7,296,702 | B2 | 11/2007 | Tanaka et al. | |
| 7,377,399 | B2 | 5/2008 | Lane et al. | |
| 7,416,090 | B2 | 8/2008 | Mooney et al. | |
| 7,455,189 | B2 | 11/2008 | Lane et al. | |
| 7,472,798 | B2 | 1/2009 | Stowitts | |
| 2001/0022291 | A1 | 9/2001 | Shinji et al. | |
| 2001/0035392 | A1 | 11/2001 | Ota et al. | |
| 2001/0054597 | A1 | 12/2001 | Tomoyuki et al. | |
| 2002/0000421 | A1 * | 1/2002 | Ota et al. | 215/381 |
| 2002/0092821 | A1 | 7/2002 | Hiromichi et al. | |
| 2003/0136754 | A1 | 7/2003 | Bourque et al. | |
| 2004/0016716 | A1 | 1/2004 | Melrose et al. | |
| 2005/0067369 | A1 | 3/2005 | Trude | |
| 2005/0121408 | A1 | 6/2005 | Deemer et al. | |
| 2005/0139572 | A1 | 6/2005 | Pedmo et al. | |
| 2005/0218108 | A1 * | 10/2005 | Bangi et al. | 215/384 |
| 2006/0065618 | A1 | 3/2006 | Pedmo et al. | |
| 2006/0070977 | A1 | 4/2006 | Howell et al. | |
| 2006/0157439 | A1 | 7/2006 | Howell | |
| 2007/0075032 | A1 | 4/2007 | Kelley et al. | |
| 2007/0090083 | A1 | 4/2007 | Trude | |

FOREIGN PATENT DOCUMENTS

| | | |
|---|---|---|
| NZ | 239179 | 5/2000 |
| NZ | 513783 | 12/2003 |
| NZ | 516023 | 4/2004 |
| WO | WO 00/50309 | 8/2000 |
| WO | WO 00/68095 | 11/2000 |
| WO | WO 2005/067419 A | 7/2005 |
| WO | WO 2006/039523 | 3/2006 |

* cited by examiner

MULTI-PANEL PLASTIC CONTAINER

CROSS REFERENCE TO RELATED APPLICATION

This application claims the priority of U.S. Provisional Patent Application No. 60/722,043, filed Sep. 30, 2005, which is hereby incorporated by reference.

FIELD OF THE INVENTION

The present invention relates to plastic containers having four controlled deflection flex vacuum panels to accommodate negative internal pressure that may be created during packaging or subsequent handling of the container.

BACKGROUND OF THE INVENTION

Containers holding liquids or other products are designed to accommodate for changes in internal pressure created during packaging or subsequent handling.

For example, hot-filled plastic containers are used for packaging certain liquids, which must be filled into the container while hot. During filling, the product is typically dispensed into the container at elevated temperatures of at least about 82 degrees Celsius. The container is then capped and, as the product cools, a negative internal pressure forms within the sealed container. Improper design may lead to deformation resulting in poor aesthetics, performance and end-user handling. Hot-filled plastic containers are typically blow molded from polyester resin and other suitable polymeric materials, such as biaxially-oriented polyethylene terephthalate (PET), and having a base, a generally cylindrical body, a shoulder, and a neck.

Internal negative pressure may also be created when a packaged product is placed in a cooler environment, e.g., placing a bottle in a refrigerator or a freezer.

To accommodate the shrinkage and negative internal pressure that develops during packaging or subsequent handling, it is known to incorporate a plurality of recessed vacuum panels into the body portion of the container. As the product cools, the vacuum panels will deform and move inwardly thereby relieving internal pressure. Labels may be used around the bell-shaped shoulder portion or to cover the vacuum panels to improve the appearance of the container.

The design of vacuum panels may vary. For example, WO 00/50309, Melrose, discloses a container comprising controlled deflection flex panels having initiator portions that may invert and flex under pressure to avoid deformation and permanent buckling. U.S. Pat. No. 5,971,184, Krishnakumar et al., discloses containers comprising only two vacuum panels and two reinforcing sections (finger grip portions). U.S. Pat. No. 6,837,390, Lane et al., discloses a container comprising a pair of opposing panels and a pair of opposing columns and forming a substantially oval cross section, wherein the columns deflect outwardly as the vacuum panels deflect inwardly. U.S. Pat. No. 6,044,996, Carew, et al., requires an odd number vacuum panels, e.g., five or seven. All references are hereby incorporated by reference.

However, standard six panel designs present difficulties with labeling and end-user handling, and two panel designs show tendency to pull on the columns or grip areas during the optimization to increase volume contraction and reduce pressure. This may contribute to unnecessary distortion on the rigid columns or grip areas and/or on the vacuum panels. Also, the substantially oval shape of these designs often leads to distortion of the shoulder and/or bottom portions of the container, thereby distorting around labels.

SUMMARY OF THE INVENTION

The foregoing deficiencies are overcome by the present invention, which reduces these effects by utilizing four controlled deflection flex vacuum panels, working in tandem in primary and secondary capacity, thereby reducing the internal pressure and increasing the amount of vacuum uptake and reducing label distortion, while still providing grippable regions to facilitate end user/consumer handling. Moreover, the unique design of the present container provides a relatively lightweight container with top-load strength similar to that of a heavier container.

The present invention relates to a container comprising a plastic body having a neck portion defining an opening, connected to a shoulder portion extending downward and connecting to a sidewall extending downward and joining a bottom portion forming a base. The sidewall may include four panels and vertical transitional walls disposed between and joining the panels. The body of the container may be adapted to increase volume contraction and reduce pressure, and the panels may be adapted to contract inwardly in response to internal negative pressure due to packaging or subsequent handling and storage. In an exemplary embodiment, the internal negative pressure may be created during hot-fill processing and subsequent cooling of a hot liquid in the container.

In another exemplary embodiment, the panels may comprise a pair of opposing primary panels and secondary panels. The primary panels may have smaller surface area than the secondary panels. In one aspect of the invention, the panels may be convex, substantially straight/flat or concave shaped (arced) and may become less convex, substantially straight/flat or more concave after contraction. For example, the secondary panels may be convex and become less convex or substantially straight/flat after contraction. In another example, the primary panels may be substantially straight/flat and become concave after contraction or convex and become concave after contraction. In one aspect, the primary panels may be adapted for greater uptake of internal negative pressure than the secondary panels.

The present invention may comprise primary panels having an upper and lower portion and/or secondary panels having an upper and lower panel walls. In an exemplary embodiment, the container may further comprise an upper bumper wall between the shoulder and the sidewall and a lower bumper wall between the sidewall and the bottom portion. In one aspect, the upper and lower bumper walls may extend continuously along the circumference of the container. In another aspect, the upper and lower portions of the primary panel may transition into the upper and lower bumper walls, respectively.

In an exemplary embodiment, the container may further comprise horizontal transitional walls defining the upper and lower portions of the primary panel. In one aspect, the horizontal transitional walls extend continuously along the circumference of the container.

In a further embodiment, the secondary panels may include at least one horizontal ribbing. In one exemplary embodiment, the secondary panels include three horizontal ribbings. The ribbings may be separated by an intermediate region or contiguous, i.e., without an intermediate region.

The present invention may further comprise at least one recessed rib or groove between the sidewall and the shoulder portion and/or at least one recessed rib or groove between the sidewall and the lower bottom portion. In one aspect, the recessed rib or groove may be continuous along the circumference of the container.

The container may be about an 8 to 64 ounce bottle. The shoulder and base of the container may be substantially round.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements. The left most digits in the corresponding reference number indicate the drawing in which an element first appears. For example, element 108 from FIG. 1 corresponds to element 408 in FIG. 4.

DETAILED DESCRIPTION

Figure 1C:
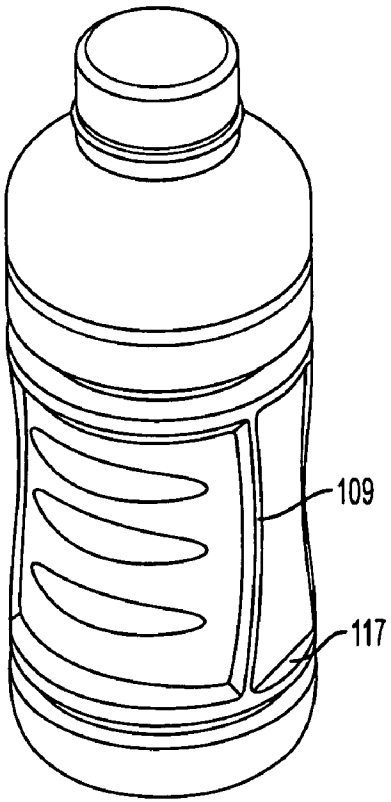
FIGS. 1A, B, C and D show elevation and cross-sectional views of a container according to an embodiment having vertically straight (substantially flat) primary panels and secondary panels with horizontal ribbings separated by intermediate regions.
Figure 1B:
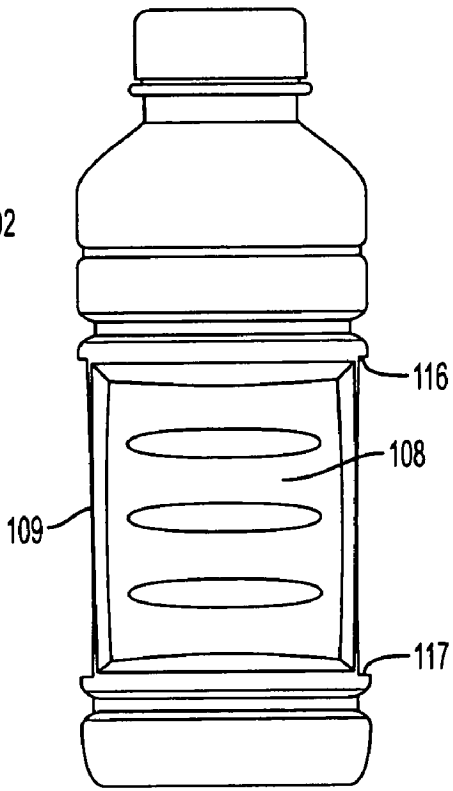
Figure 1A:
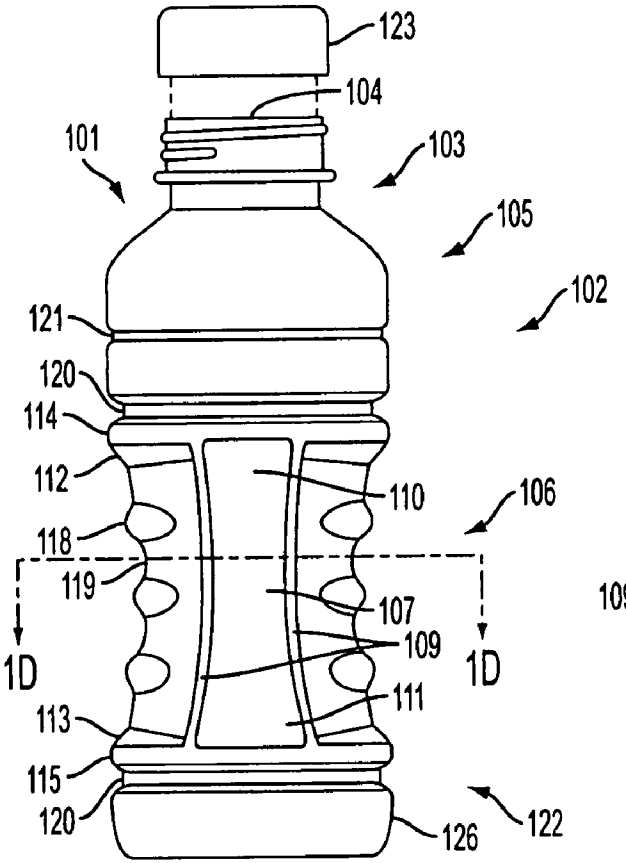
Figure 1D:
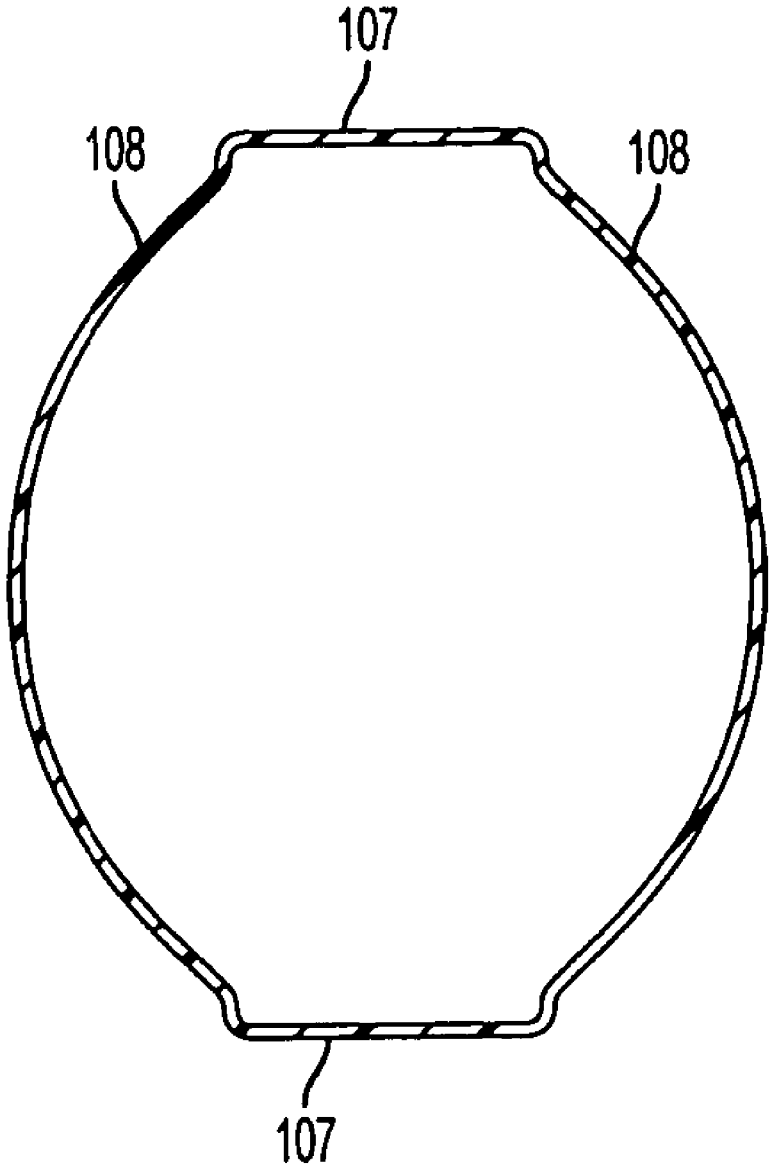
Figure 2C:
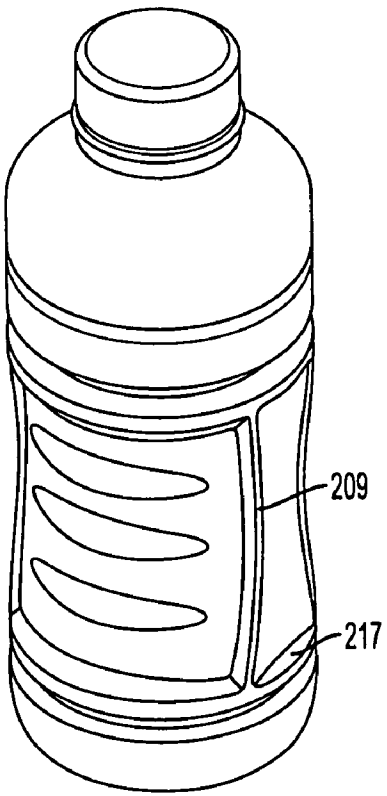
FIGS. 2A, B, C and D show elevation and cross-sectional views of a container according to an embodiment having vertically concave shaped (arced) primary panels that are horizontally relatively flat/slightly concave and secondary panels with horizontal ribbings separated by intermediate regions.
Figure 2B:
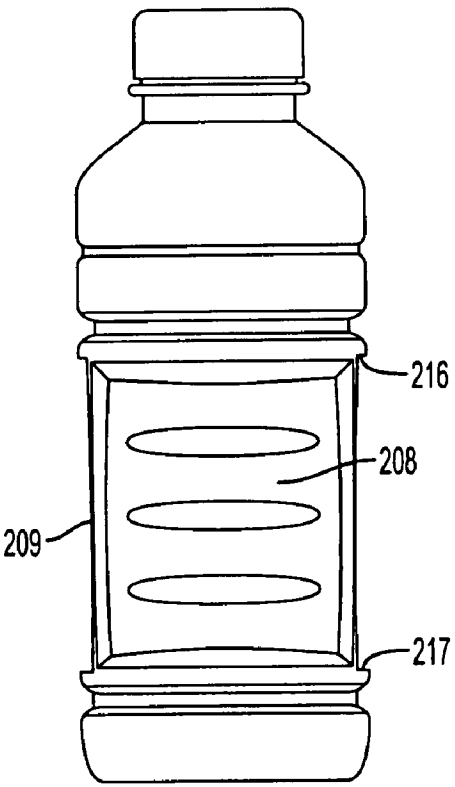
Figure 2A:
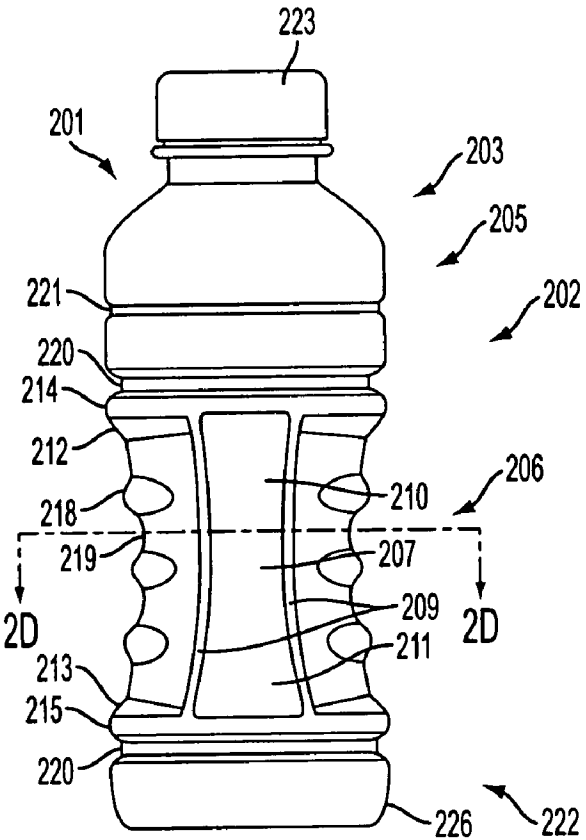
Figure 2D:
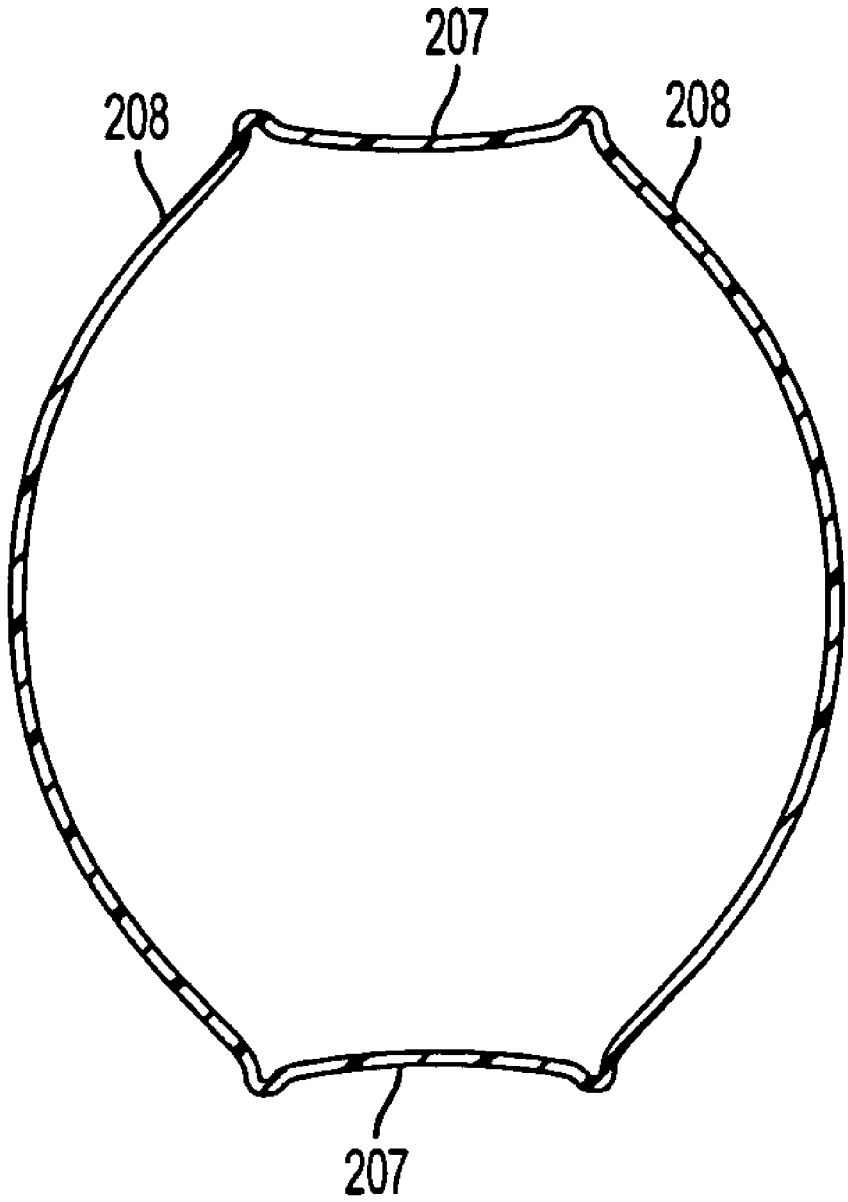

The present invention, e.g., FIG. 1, relates to a container 101 having four controlled deflection flex (vacuum) panels 107 and 108, working in tandem in primary and secondary capacity, thereby reducing the negative internal pressure effects during cooling of a product.

For example, the container 101 is able to withstand the rigors of hot fill processing. In a hot fill process, a product is added to the container at an elevated temperature, about 82° C., which can be near the glass transition temperature of the plastic material, and the container is capped. As the container and its contents cool, the contents tend to contract and this volumetric change creates a partial vacuum within the container. Other factors can cause contraction of the container content, creating an internal vacuum that can lead to distortion of the container. For example, internal negative pressure may be created when a packaged product is placed in a cooler environment, e.g., placing a bottle in a refrigerator or a freezer, or from moisture loss within the container during storage.

In the absence of some means for accommodating these internal volumetric and barometric changes, containers tend to deform and/or collapse. For example, a round container can undergo ovalization, or tend to distort and become out of round. Containers of other shapes can become similarly distorted. In addition to these changes that adversely affect the appearance of the container, distortion or deformation can cause the container to lean or become unstable. This is particularly true where deformation of the base region occurs. As supporting structures are removed from the side panels of a container, base distortion can become problematic in the absence of mechanism for accommodating the vacuum. Moreover, configuration of the panels provides additional advantages, e.g., improved top-load performance allowing the container to be lighter in weight.

The novel design of container 101 increases volume contraction and vacuum uptake, thereby reducing negative internal pressure and unnecessary distortion of the container 101 to provide improved aesthetics, performance and end user handling.

As shown in FIG. 1, the container 101 may comprise a plastic body 102, e.g., suitable for hot-fill application, having a neck portion 103 defining an opening 104, connected to a shoulder portion 105 extending downward and connecting to a sidewall 106 extending downward and joining a bottom portion 122 forming a base 126. The sidewall 106 includes four controlled deflection flex (vacuum) panels 107 and 108 and includes a vertical transitional wall 109 disposed between and joining the primary and secondary panels 107 and 108. The body 102 of the container 101 is adapted to increase volume contraction and reduce pressure during packaging and subsequent handling, e.g., hot-fill processing, and the panels 107 and 108 are adapted to contract inward from vacuum forces created from the cooling of a liquid, e.g., during hot-fill application.

The container 101 can be used to package a wide variety of liquid, viscous or solid products including, for example, juices, other beverages, yogurt, sauces, pudding, lotions, soaps in liquid or gel form, and bead shaped objects such as candy.

The present container can be made by conventional blow molding processes including, for example, extrusion blow molding, stretch blow molding and injection blow molding. In extrusion blow molding, a molten tube of thermoplastic material, or plastic parison, is extruded between a pair of open blow mold halves. The blow mold halves close about the parison and cooperate to provide a cavity into which the parison is blown to form the container. As formed, the container can include extra material, or flash, at the region where the molds come together, or extra material, or a moil, intentionally present above the container finish. After the mold halves open, the container drops out and is then sent to a trimmer or cutter where any flash of moil is removed. The finished container may have a visible ridge formed where the two mold halves used to form the container came together. This ridge is often referred to as the parting line.

In stretch blow molding, a preformed parison, or preform, is prepared from a thermoplastic material, typically by an injection molding process. The preform typically includes a threaded end, which becomes the threads of the container. The preform is positioned between two open blow mold halves. The blow mold halves close about the preform and cooperate to provide a cavity into which the preform is blown to form the container. After molding, the mold halves open to release the container. In injection blow molding, a thermoplastic material, is extruded through a rod into an inject mold to form a parison. The parison is positioned between two open blow mold halves. The blow mold halves close about the parison and cooperate to provide a cavity into which the parison is blown to form the container. After molding, the mold halves open to release the container.

In one exemplary embodiment, the container may be in the form of a bottle. The size of the bottle may be from about 8 to 64 ounces, from about 16 to 24 ounces or 16 ounces or 20 ounce bottles. The weight of the container may be based on gram weight as a function of surface area, e.g., 4.5 square inches per gram to 2.1 square inches per gram.

The sidewall, as formed, is substantially tubular and can have a variety of cross sectional shapes. Cross sectional shapes include, for example, a circular transverse cross section; a substantially square transverse cross section; other substantially polygonal transverse cross sectional shapes such as triangular, pentagonal, etc.; or combinations of curved and arced shapes with linear shapes. As will be understood, when the container has a substantially polygonal transverse cross sectional shape, the corners of the polygon are typically rounded or chamfered.

In an exemplary embodiment, the shape of container, e.g., the sidewall, the shoulder and/or the base of the container may be substantially round or substantially square shaped. For example, the sidewall can be substantially round (e.g., as in FIG. 1) or substantially square shaped (e.g., as in FIG. 9).

The container 101 has a one-piece construction and can be prepared from a monolayer plastic material, such as a polyamide, for example, nylon; a polyolefin such as polyethylene, for example, low density polyethylene (LDPE) or high density polyethylene (HDPE), or polypropylene; a polyester, for example polyethylene terephthalate (PET), polyethylene naphtalate (PEN); or others, which can also include additives to vary the physical or chemical properties of the material. For example, some plastic resins can be modified to improve the oxygen permeability. Alternatively, the container can be prepared from a multilayer plastic material. The layers can be any plastic material, including virgin, recycled and reground material, and can include plastics or other materials with additives to improve physical properties of the container. In addition to the above-mentioned materials, other materials often used in multilayer plastic containers include, for example, ethylvinyl alcohol (EVOH) and tie layers or binders to hold together materials that are subject to delamination when used in adjacent layers. A coating may be applied over the monolayer or multilayer material, for example to introduce oxygen barrier properties. In an exemplary embodiment, the present container may be made of a generally biaxially oriented polyester material, e.g., polyethylene terephthalate (PET), polypropylene or any other organic blow material which may be suitable to achieve the desired results.

In another embodiment, the shoulder portion, the bottom portion and/or the sidewall may be independently adapted for label application. The container may include a closure 123 (e.g., FIGS. 1-13) engaging the neck portion and sealing the fluid within the container.

As exemplified in FIG. 1, the four panels 107 and 108 may comprise a pair of opposing primary panels 107 and a pair of secondary panels 108, which work in tandem in primary and secondary capacity.

Generally, the primary panels may comprise smaller surface area and/or have a geometric configuration adapted for greater vacuum uptake than the secondary panels. In an exemplary embodiment, the size of the secondary panel to primary panel may be slightly larger than the primary panel, e.g., at least about 1:1 (e.g., FIG. 9). In another aspect, the size of the secondary panel to primary panel may be in a ratio of about 3:1 or 7:5 or the secondary panel may be at least 70% larger than the primary panel, or 2:1 or 50% larger.

Prior to relief of negative internal pressure, e.g., during hot-fill processing, the primary panels and secondary panels may be designed to be convex, substantially straight/flat or concave shaped, and/or combinations thereof, so that after cooling of a closed container or after filling the container with hot product, sealing and cooling, the primary panels and/or secondary panels would decrease in convexity, become vertically substantially straight/flat or increase in concavity. The convexity or concavity of the primary and/or the secondary panels may be in the vertical or horizontal directions, e.g., in the up and down direction or around the circumference or both. In alternative embodiments, the secondary panels may be slightly convex while the primary panels are substantially straight/flat, concave or less convex. Alternatively, the secondary panels may be substantially straight/flat and the primary panel concave.

The primary and secondary panels cooperate to relieve internal negative pressure due to packaging or subsequent handling and storage. Of the pressure relieved, the primary panels are responsible for greater than 50% of the vacuum relief or uptake. The secondary panel may be responsible for at least a portion, e.g., 15% or more, of the vacuum relief or uptake. For example, the primary panels may absorb greater than 50%, 56% or 85% of a vacuum developed within developed within the container, e.g., upon cooling, e.g., after hot-filling.

Generally, the primary panels are substantially devoid of structural elements, such as ribs, and are thus more flexible, have less deflection resistance, and therefore have more deflection than secondary panels, although some minimal ribbing may be present to add structural support to the container overall. The panels may progressively exhibit an increase in deflection resistance as the panels are deflected inward.

In an alternative embodiment, the primary panel, secondary panel, shoulder portion, the bottom portion and/or the sidewall may include an embossed motif or lettering (not shown).

As exemplified in FIG. 1, the primary panels may comprise upper and lower portions, 110 and 111, respectively, and the secondary panels may comprise an upper and lower panel walls, 112 and 113, respectively.

The primary or secondary panels may independently vary in width progressing from top to bottom thereof, e.g., the panels may remain similar in width progressing from top to bottom thereof (linear), may have an hour-glass shape, may have an oval shape having a wider middle portion than the top and/or bottom, or the top potion of the columns may be wider than the bottom portion of the panel (expanding) or vice-a-versa.

Figure 8C:
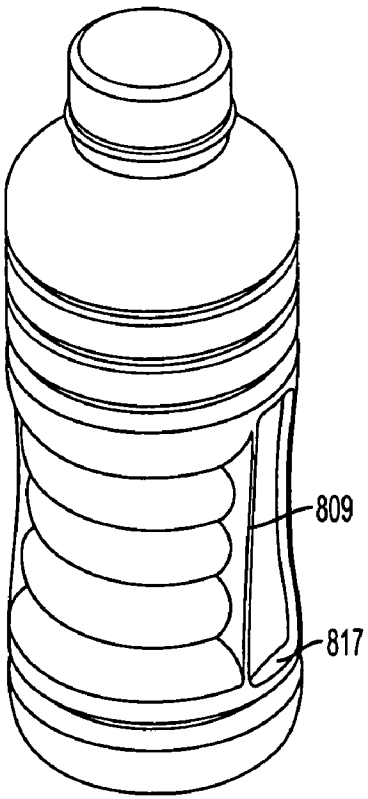
FIGS. 8A, B and C show elevation views of a container according to an embodiment having concave shaped (arced) and contoured primary panels and secondary panels with contiguous, i.e., not separated by intermediate region, horizontal ribbings.
Figure 8B:
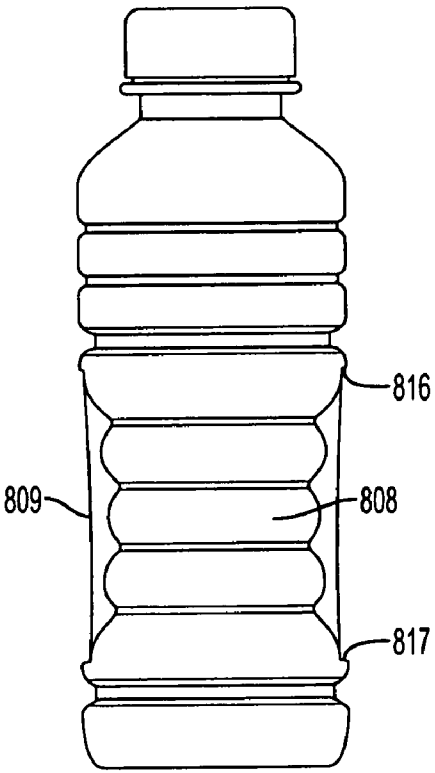
Figure 8A:
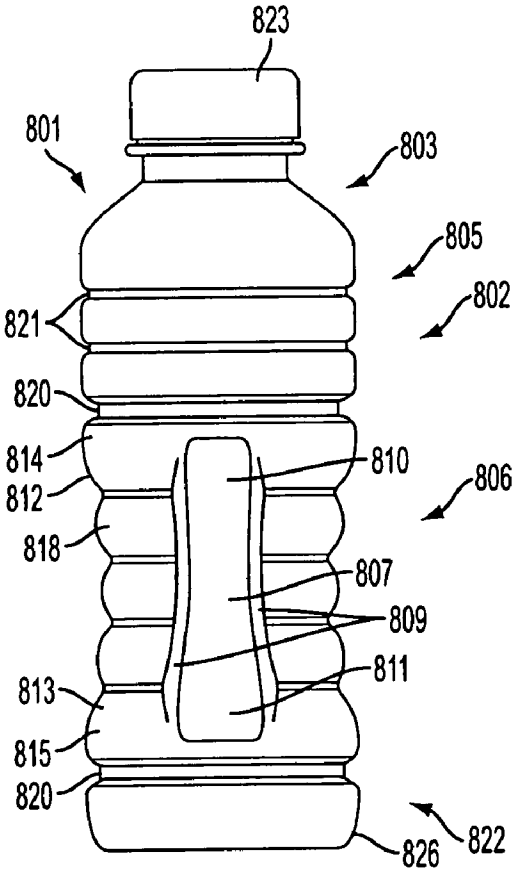

As shown in the embodiment of FIG. 1, the primary panels 107 are vertically straight (e.g., substantially or generally flat) and have an hour glass shape progressing from top to bottom thereof. The secondary panels 108 are vertically concave (e.g., arced inwardly in progressing from top to bottom), and have a generally consistent width progressing from top to bottom thereof, although the width varies slightly with the hour glass shape of the primary panels. In other exemplary embodiments, for example those shown in FIGS. 2-7, the primary panels, e.g., 207, can be vertically concave shaped (e.g., arced moderately in progressing from top to bottom) and have an hour glass shape progressing from top to bottom thereof. In one aspect, the primary panels may be vertically concave shaped (arced) and horizontally relatively straight/flat/slightly concave (e.g., FIGS. 2C and 2D). The secondary panels in the exemplary embodiments shown in FIGS. 1-8, e.g., 208 are vertically concave (arced) and have consistent width progressing from top to bottom thereof. In another embodiment, primary and/or the secondary panel may have a vertically convex shape with a wider middle section than the top and bottom of the primary panel (not shown). In still other exemplary embodiments, for example as illustrated in FIG. 8, the primary panels 807 can be vertically concave shaped (arced) and become wider progressing from top to bottom thereof. The secondary panels 808 can be vertically concave (arced) and have consistent width progressing from top to bottom thereof.

Figure 9C:
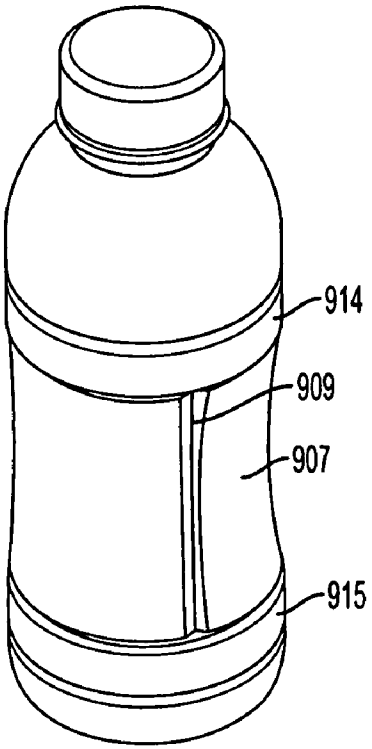
FIGS. 9A, B, C and D show elevation and cross-sectional views of a container according to an embodiment having primary panels and secondary panels similar in size with no ribbings but different geometries.
Figure 9B:
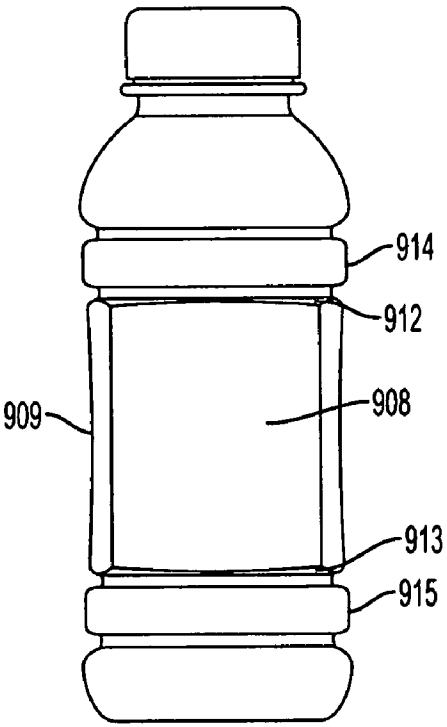
Figure 9A:
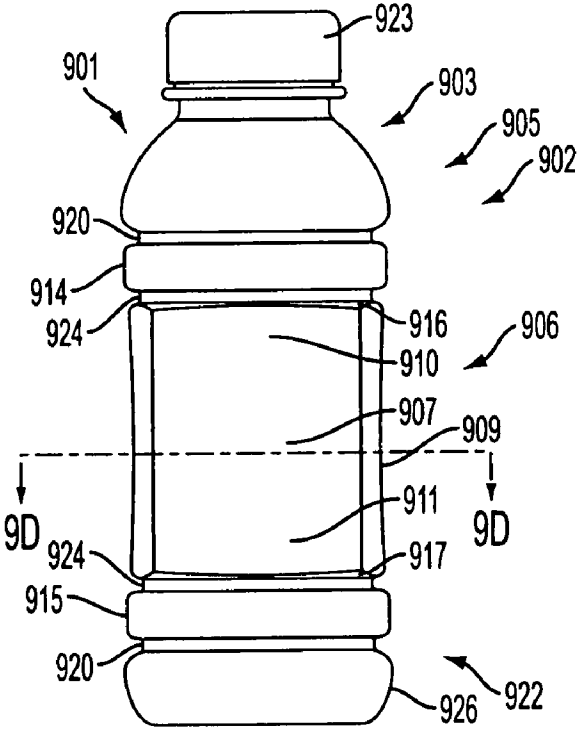
Figure 9D:
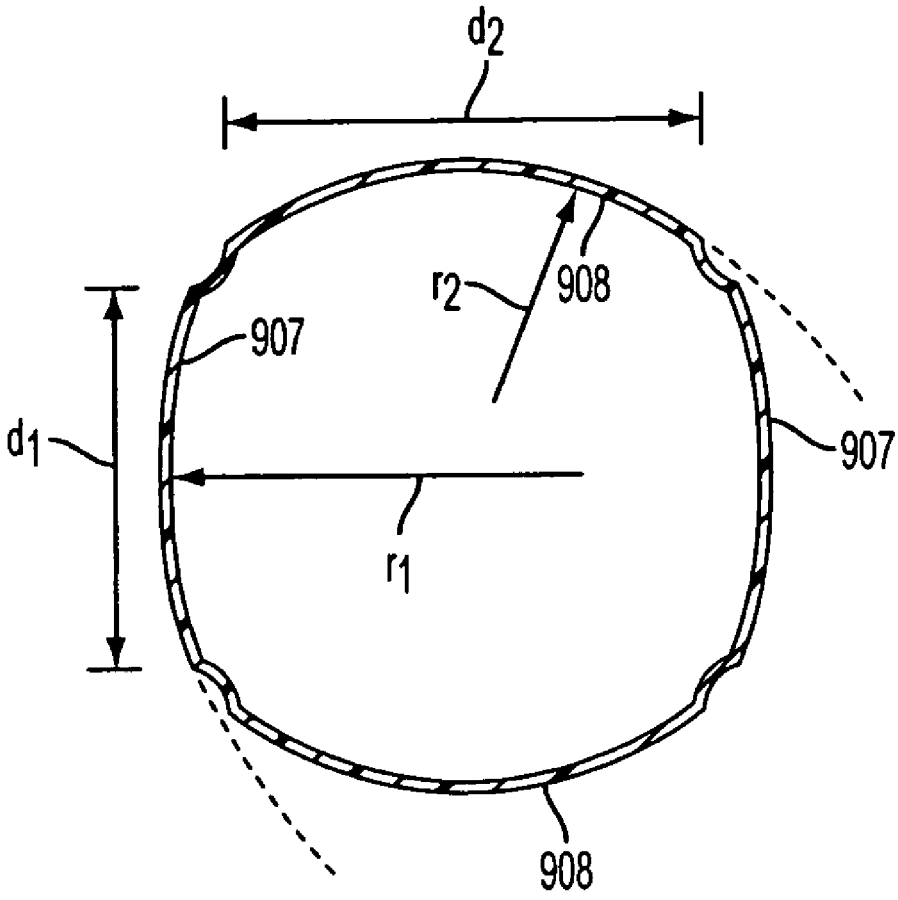

In an alternative embodiment, all four panels are similar in size, e.g., $d_1$ is approximately the same as $d_2$, as exemplified in FIG. 9D, which is a cross-section of line 9D-9D of FIG. 9A. The primary panels 907 are vertically concave (e.g., arced inwardly in progressing from top to bottom), and have a generally consistent width progressing from top to bottom thereof, and the secondary panel 908 are vertically straight (e.g., substantially or generally flat), and have a generally consistent width progressing from top to bottom thereof. In such an embodiment, the primary panels are configured in a way to be more responsive to internal vacuum than the secondary panels. For example, the primary panels 907 are horizontally flatter, i.e. less arcuate, than are the secondary panes 908. That is, the radius of curvature ($r_1$) of the primary panels is greater than the radius of curvature ($r_2$) of the secondary panels (see FIG. 9D). These differences in curvature result in the primary panels having an increased ability for flexure, thus allowing the primary panels to account for the majority (for example, greater than 50%) of the total vacuum relief accomplished in the container.

Figure 10C:
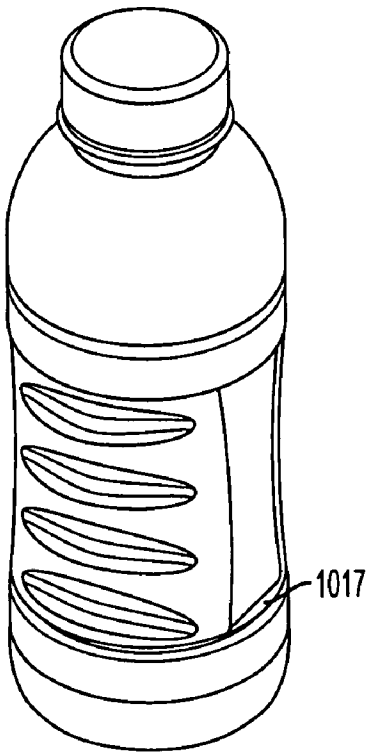
FIGS. 10A, B and C show elevation views of a container according to an embodiment having vertically straight (substantially flat) primary panels and secondary panels having inwardly directed ribbings separated by intermediate regions.
Figure 10B:
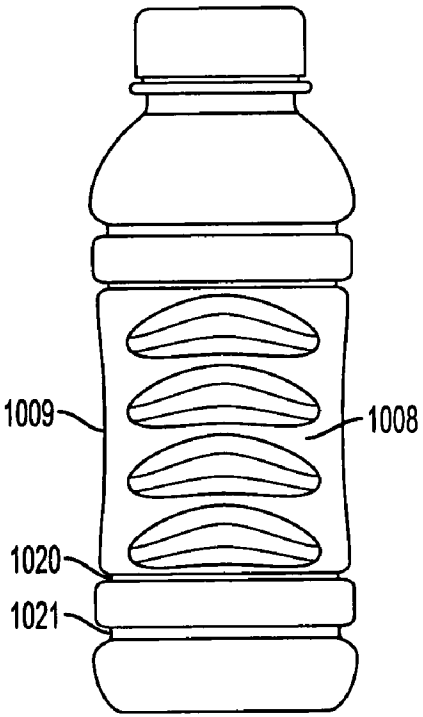
Figure 10A:
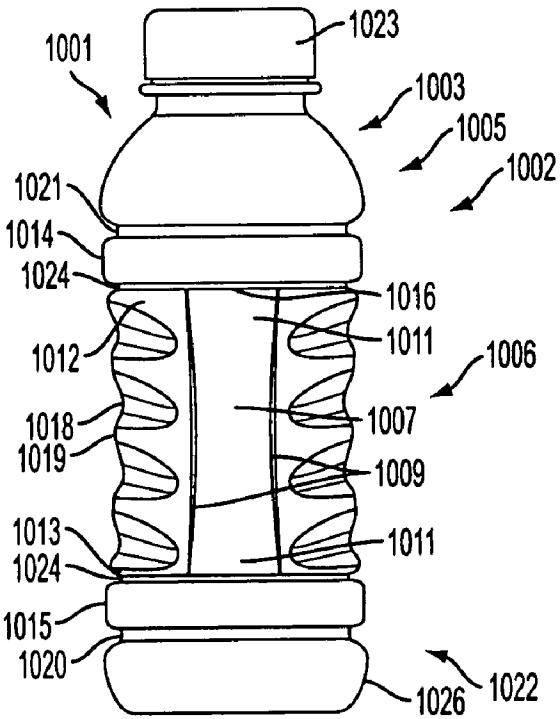

In other embodiments, as exemplified in FIG. 10, the primary panels, e.g., 1007 can be vertically straight shaped (substantially flat) and have a consistent width progressing from top to bottom. The secondary panels, e.g., 1008 can be vertically straight shaped (substantially flat) and have consistent width progressing from top to bottom thereof.

Figure 12C:
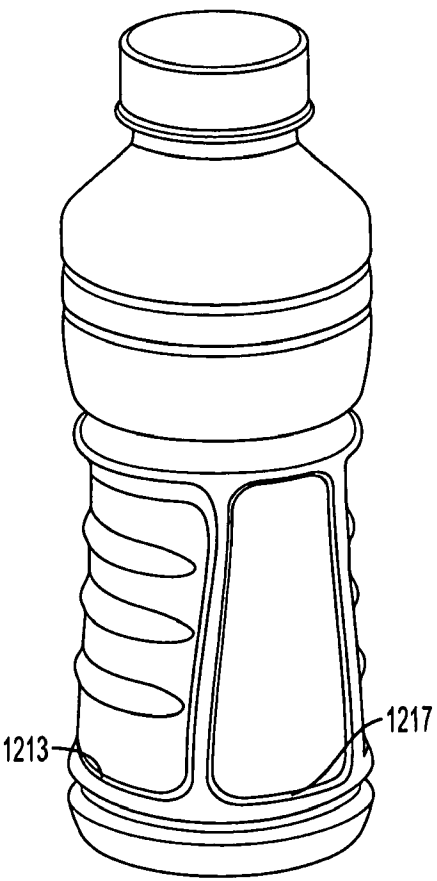
FIGS. 12A, B and C show elevation views of a container according to an embodiment having an alternatively contoured vertically straight (substantially flat) primary panels and secondary panels with horizontal ribbings separated by intermediate regions.
Figure 12B:
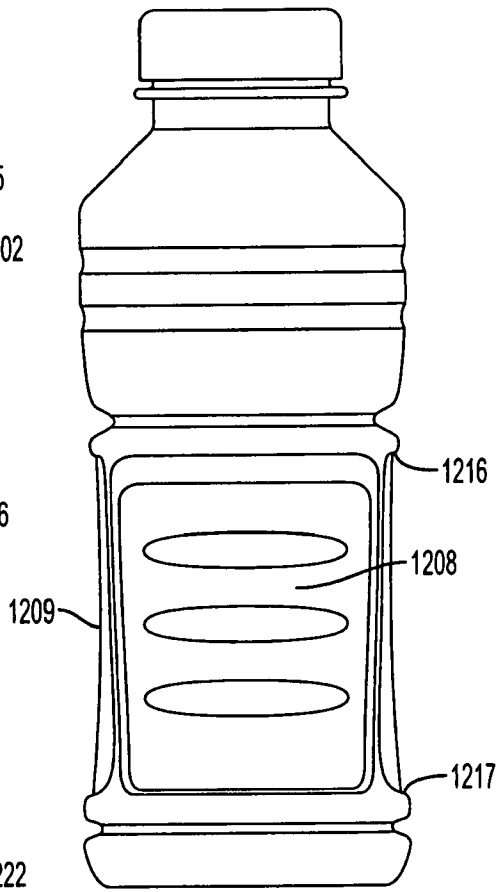
Figure 12A:
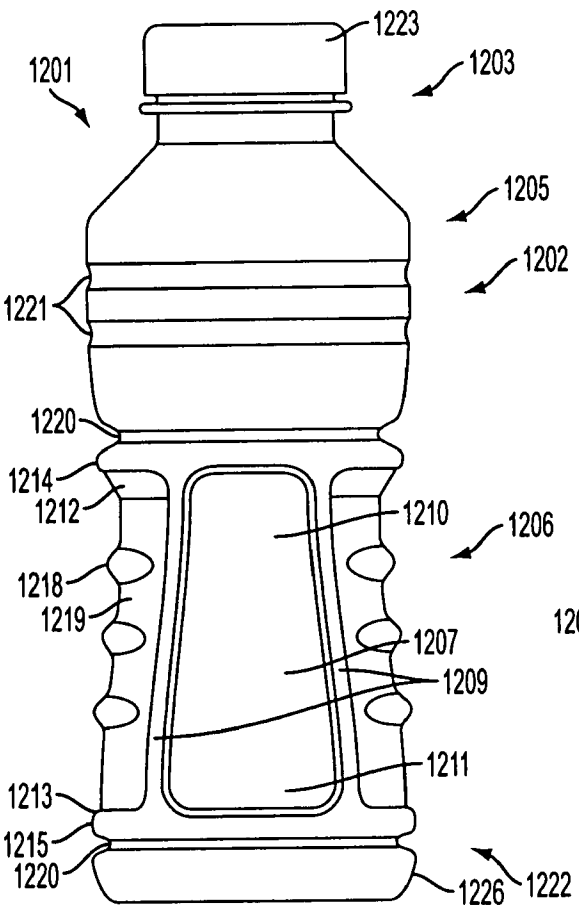
Figure 13C:
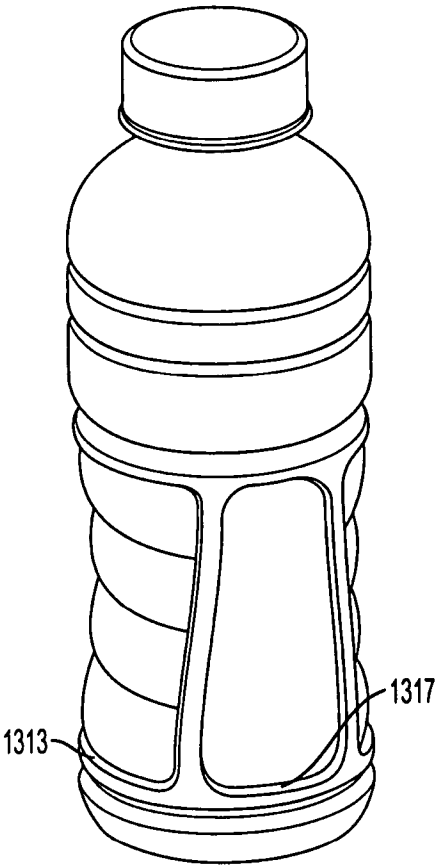
FIGS. 13A, B and C show elevation views of a container according to an embodiment having an alternatively contoured vertically straight (substantially flat) primary panels and secondary panels with contiguous, i.e., not separated by intermediate region, horizontal ribbings.
Figure 13B:
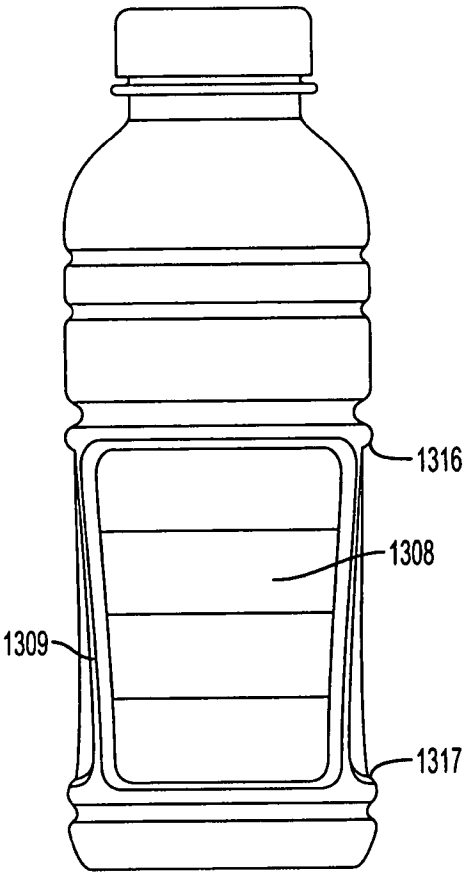
Figure 13A:
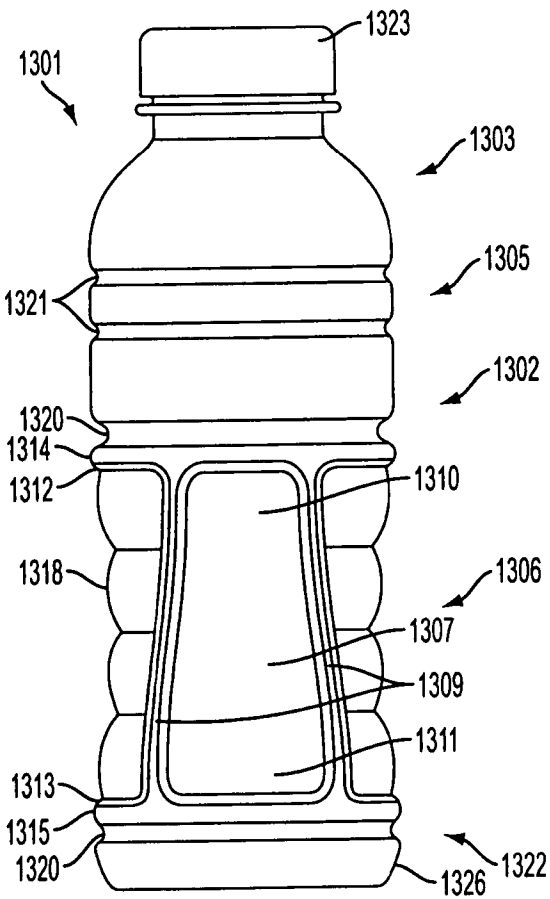

The present invention may include a variety of these combinations and features. For example, as shown in FIGS. 12 and 13, the primary panels 1207 are vertically straight (e.g., substantially or generally flat) and have a contoured shaped that becomes wider progressing from top to bottom thereof. In other exemplary embodiments (not shown), the secondary panels become progressively wider from top to bottom thereof, so that the upper panel wall is larger than the lower panel wall, and as a result, the upper portion of the secondary panel is more recessed than the lower portion.

The container 101 may also include an upper bumper wall 114 between the shoulder 105 and the sidewall 106 and a lower bumper wall 115 between the sidewall 106 and the bottom portion 122. The upper and/or lower bumper walls may define a maximum diameter of the container, or alternatively may define a second diameter, which may be substantially equal to the maximum diameter.

In the embodiments exemplified in FIGS. 1, 2 and 4-13, the upper bumper wall, e.g., 114, and lower bumper wall, e.g., 115, may extend continuously along the circumference of the container. As exemplified in FIGS. 1, 6 and 8-13, the container may also include horizontal transitional walls 116 and 117 defining the upper portion 110 and lower portion 111 of the primary panel 107 and connecting the primary panel to the bumper wall.

Figure 11C:
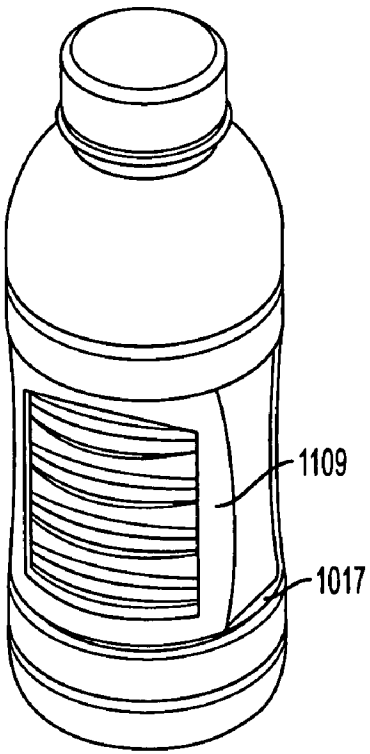
FIGS. 11A, B and C show elevation views of a container according to an embodiment having vertically straight (substantially flat) primary panels and secondary panels having inwardly horizontal ribbings separated by intermediate regions.
Figure 11B:
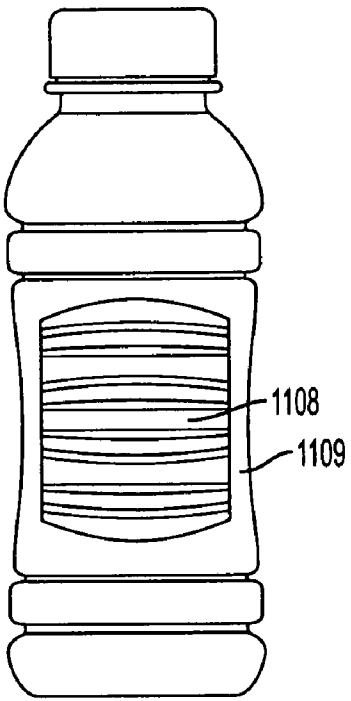
Figure 11A:
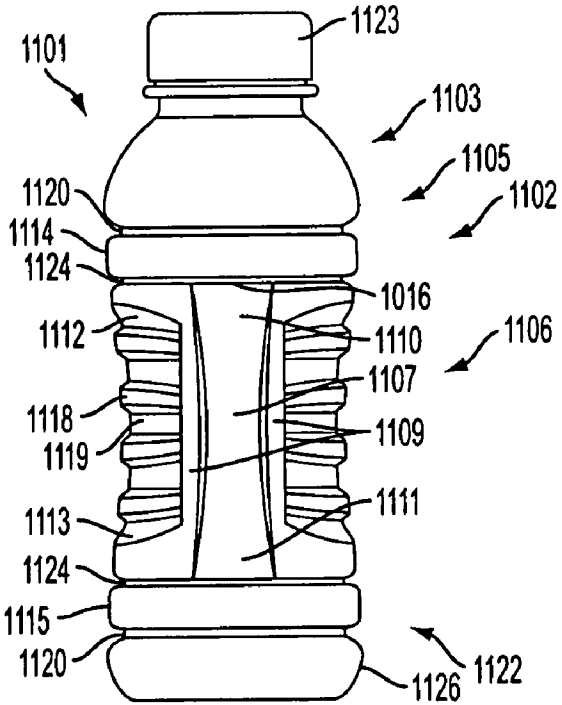

As in FIGS. 9-11, the horizontal transitional walls, e.g., 916 and 917, may extend continuously along the circumference of the container 901. Alternatively, as exemplified in FIGS. 4, 5, and 7, the horizontal transition walls may be absent such that the upper portion, e.g., 410 and lower portion, e.g., 411 of the primary panel, e.g., 407, transition (blend) into said upper bumper wall, e.g., 414, and lower bumper wall, e.g., 415, respectively.

Figure 3C:
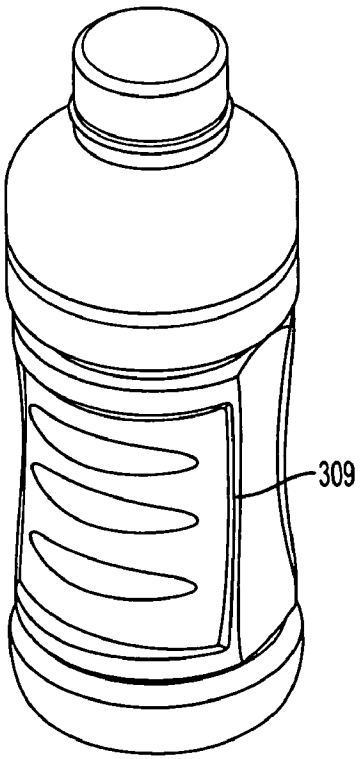
FIGS. 3A, B and C show elevation views of a container according to an embodiment having concave shaped (arced) primary panels extending through the upper (top) and lower (bottom) bumper walls (waists) and secondary panels with horizontal ribbings separated by intermediate regions.
Figure 3B:
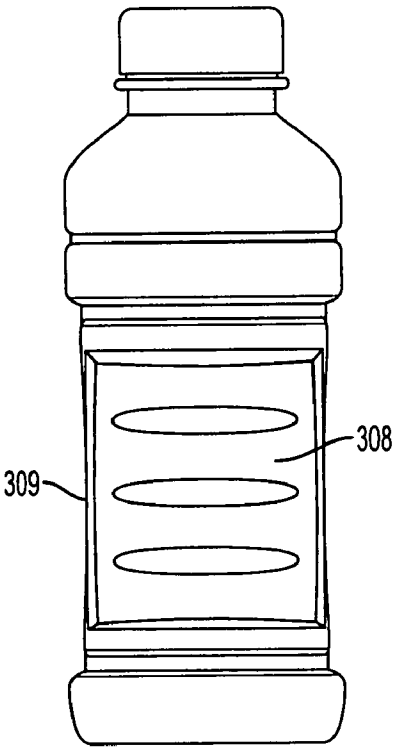
Figure 3A:
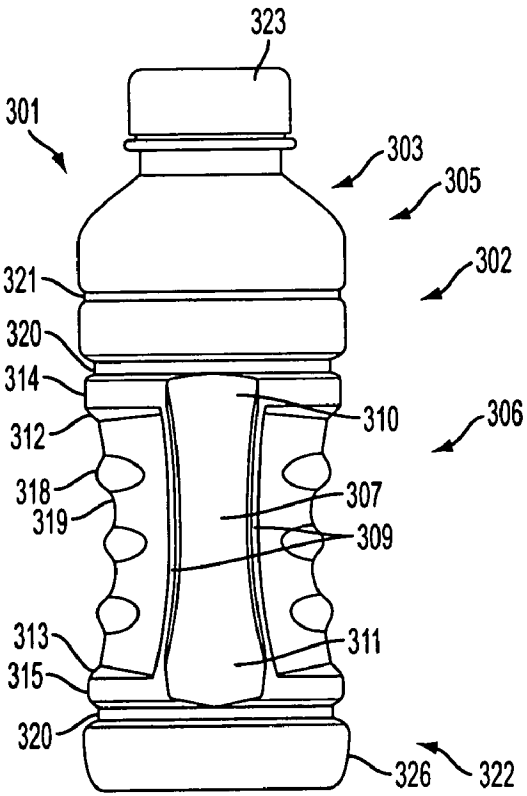
Figure 4C:
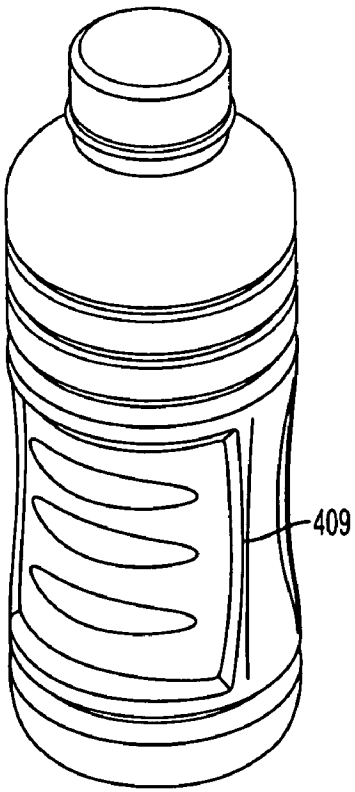
FIGS. 4A, B and C show elevation views of a container according to an embodiment having concave shaped (arced) primary panels blended into the upper (top) and lower (bottom) bumper walls (major diameters) and secondary panels with horizontal ribbings separated by intermediate regions.
Figure 4B:
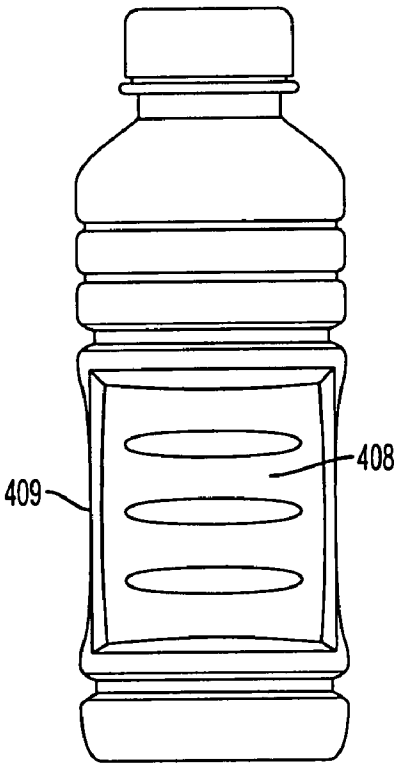
Figure 4A:
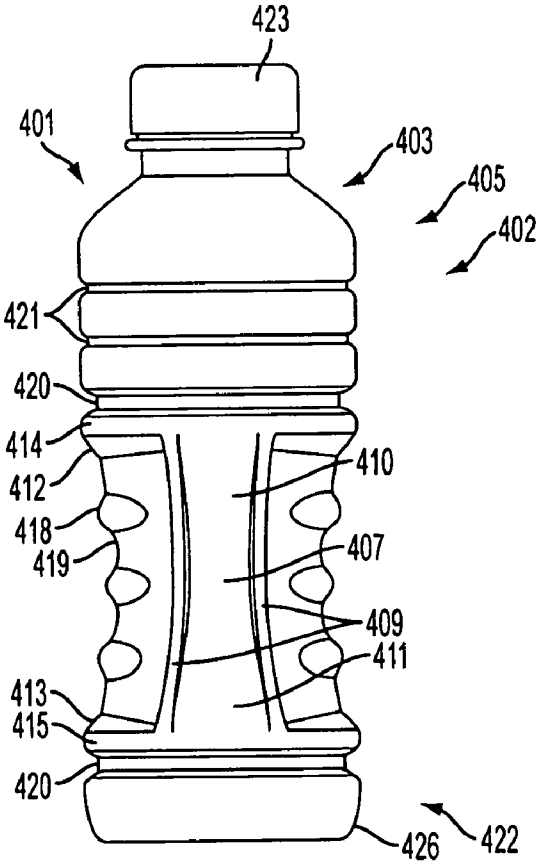
Figure 5C:
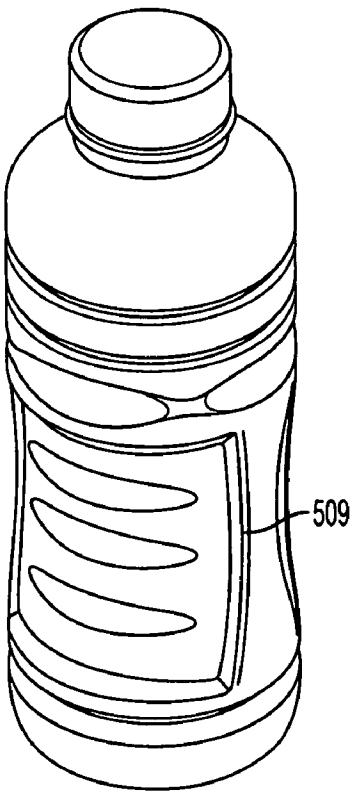
FIGS. 5A, B and C show elevation views of a container according to an embodiment having concave shaped (arced) primary panels blended into upper (top) and lower (bottom) bumper walls, indented recessed rib or groove and secondary panels with horizontal ribbings separated by intermediate regions.
Figure 5B:
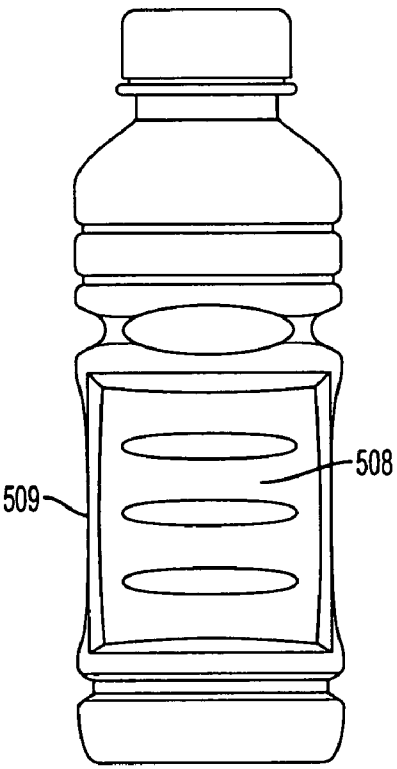
Figure 5A:
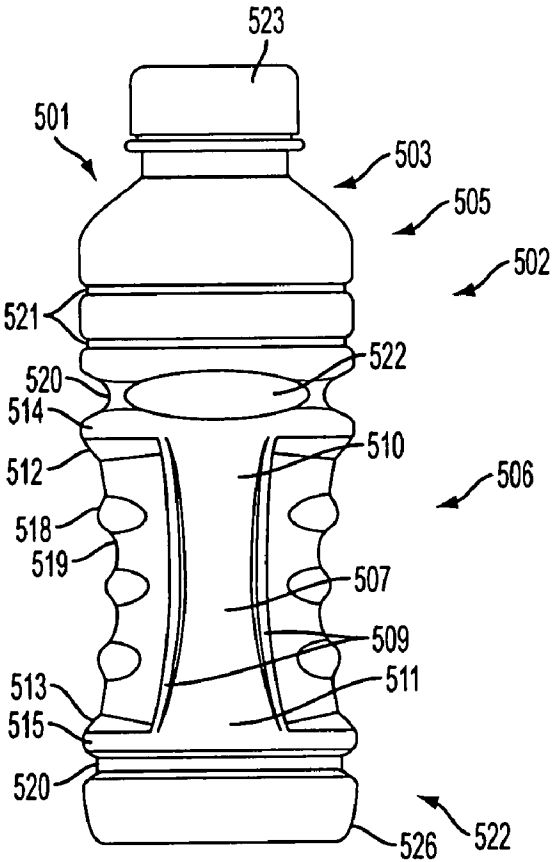
Figure 6C:
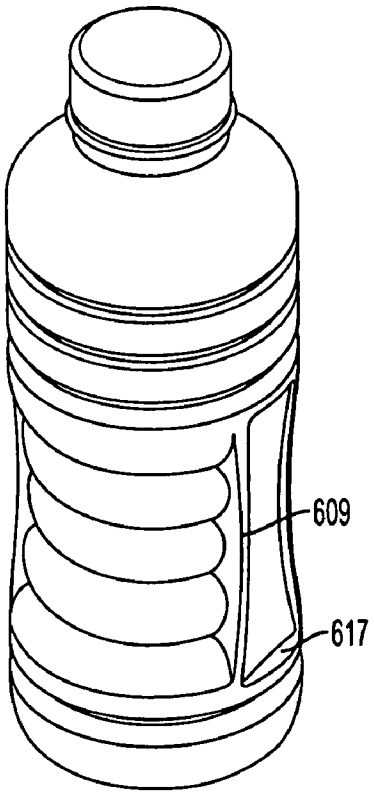
FIGS. 6A, B and C show elevation views of a container according to an embodiment having concave shaped (arced) primary panels and secondary panels with contiguous, i.e., not separated by intermediate region, horizontal ribbings.
Figure 6B:
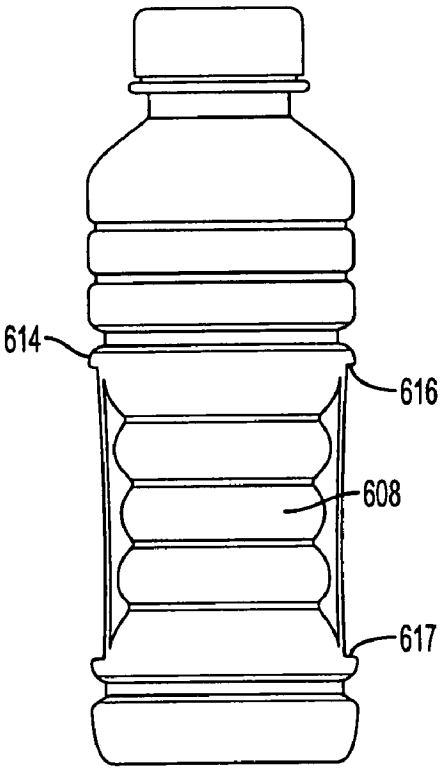
Figure 6A:
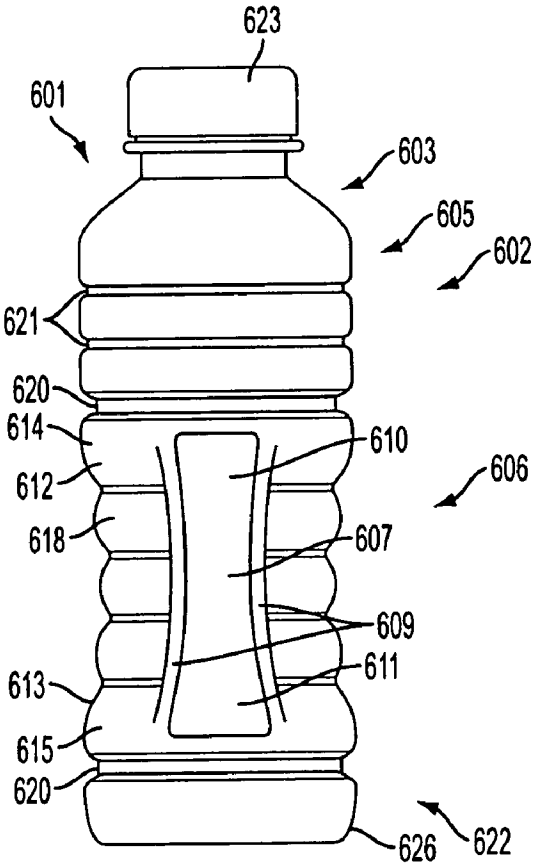
Figure 7C:
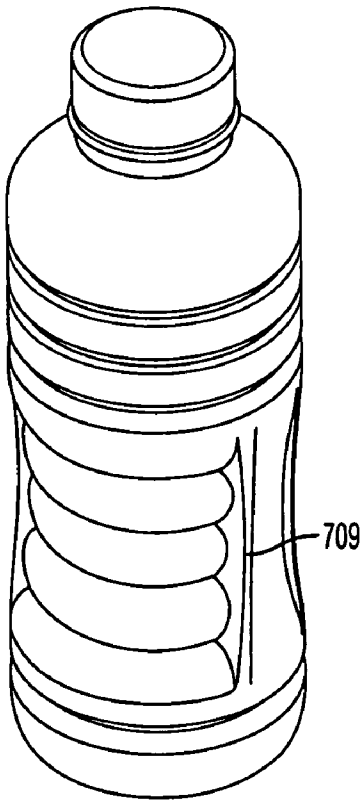
FIGS. 7A, B and C show elevation views of a container according to and embodiment having concave shaped (arced) primary panels blended into the upper (top) and lower (bottom) horizontal transitional walls (major diameters) and secondary panels with contiguous, i.e., not separated by intermediate region, horizontal ribbings.
Figure 7B:
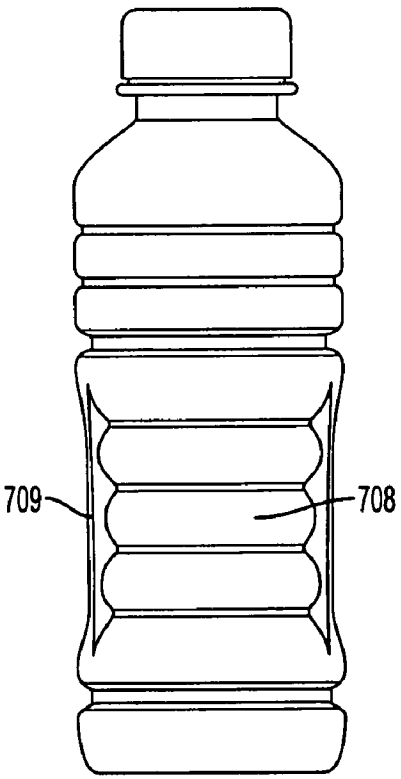
Figure 7A:
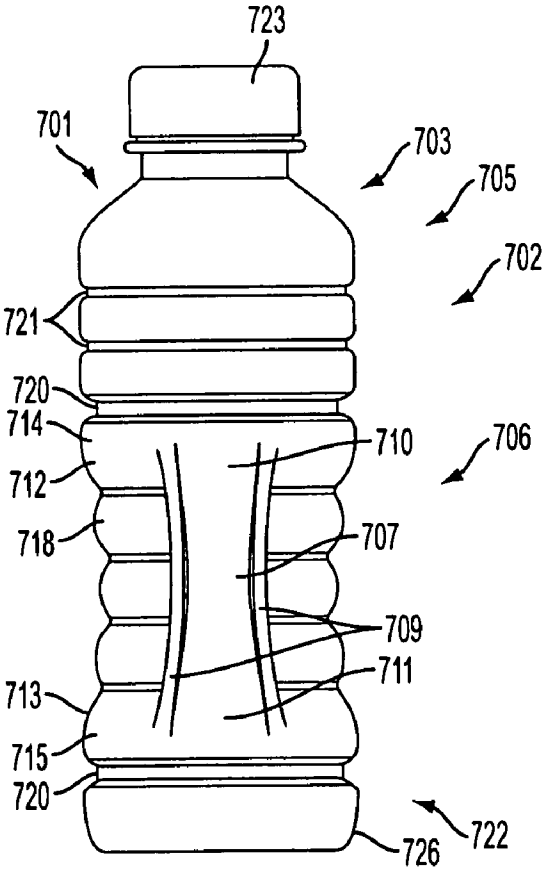

In exemplary embodiments having a primary panel that transition into the bumper wall, e.g., as in the embodiment of FIG. 3, the primary panel 307 can lack a horizontal transition wall at the top 310 and/or the bottom 311 of the primary panel 307. As shown in FIG. 3, the upper 310 and lower 311 portion of the primary panel 307 extend through the upper bumper wall 314 and lower bumper wall 315, respectively, so that the upper 314 and lower 315 bumper walls are discontinuous.

In some exemplary embodiments, e.g., FIGS. 1-8 and 10-13, the secondary panels may be contoured to include grip regions, which have anti-slip features projecting inward or outward, while providing secondary means of vacuum uptake. In such embodiments, the primary panels provide the primary means of vacuum uptake. The resultant exemplary design thereby reduces the internal pressure and increasing the amount of vacuum uptake and reduces label distortion, while still providing grippable regions to facilitate end user/consumer handling.

The secondary panels 108 may include at least one horizontal ribbing 118 (FIGS. 1-8 and 10-11). As exemplified in FIGS. 1-5 and 12, the secondary panels 108 can include, for example, three outwardly projecting horizontal ribbings separated by an intermediate region 119. As exemplified in FIGS. 6-8 and 13, the horizontal ribbings, e.g., 618, can be contiguous, i.e., not separated by intermediate region.

FIG. 10 illustrates an embodiment having inwardly directed recessed ribbings 1018 separated by intermediate regions 1019 and FIG. 11 shows inwardly recessed ribbings 1118 having a more horizontal transition from the intermediate regions 1119.

As can be seen in FIG. 1, the container 101 may include at least one recessed rib or groove 120 between the upper bumper wall 114 and the shoulder portion 105 and/or between the lower bumper wall 115 and the base 126. Alternatively, as exemplified in FIGS. 9, 10 and 11, the container, e.g., 1001, may include at least one recessed rib or groove 1024 between the upper 1014 and/or lower 1015 bumper wall and the primary 1007 and secondary 1008 panels. The recessed rib or groove 120 may be continuous along the circumference of the container 101 (FIGS. 1-4 and 6-11). In another embodiment, the container 101 may contain at least a second recessed rib or groove 121 above the recessed rib or groove 120 above said upper bumper wall (FIGS. 1-3) or two second recessed ribs or grooves 421 (FIGS. 4-11). The second recessed rib or groove, e.g., 121 or 421, may be of lesser or greater height than the recessed rib or groove 120. In yet another embodiment, the recessed rib or groove 520 above the upper bumper wall 514 can comprise an indented portion 522 (FIG. 5), such that the rib or groove is discontinuous.

In a further embodiment, the container may be a squeezable container which delivers or dispenses a product when squeezed. In this embodiment, the container, once opened, may be easily held or gripped, e.g., with one hand, and with little resistance, the container may be squeezed along the primary or secondary panels to dispense product there from. Once squeezing pressure is reduced, the container retains its original shape without undue distortion.

The invention has been disclosed in conjunction with presently preferred embodiments thereof, and a number of modifications and variations have been discussed. Other modifications and variations will readily suggest themselves to persons of ordinary skill in the art. In particular, various combinations of configurations of the primary and secondary panels have been discussed. Various other container features have also been incorporated with some combinations. The present invention includes combinations of differently configured primary and secondary panels other than those described. The invention also includes alternative configurations with different container features. For example, the indented portion 522 of the upper bumper wall 514 can be incorporated into other embodiments. The invention is intended to embrace all such modifications and variations as fall within the spirit and broad scope of the appended claims.

We claim:

1. A container comprising a plastic body having a neck portion defining an opening, connected to a shoulder portion extending downward and connecting to a sidewall extending downward and joining a bottom portion forming a base, said sidewall including four panels, wherein said four panels are vacuum panels, and including vertical transitional walls disposed between and joining said panels, wherein said body is adapted to increase volume contraction and reduce pressure, and said panels are adapted to contract inwardly in response to internal negative pressure created during hot-fill processing and subsequent cooling of a hot liquid in said container; and;

wherein at least one of said panels is adapted for greater uptake of internal negative pressure than one other of said panels, wherein said panels comprise primary panels and secondary panels and wherein said primary panels comprise smaller surface area than said secondary panels;

and further wherein the container comprises horizontal transitional walls; wherein the secondary panels are recessed with respect to the horizontal transitional walls; and wherein said secondary panels include horizontal ribbings; wherein said horizontal ribbings are contiguous without being separated by intermediate regions, and further wherein said secondary panels are vertically arced.

2. The container of claim 1, wherein the container is about an 8 to 64 ounce bottle.

3. The container of claim 1, wherein the shoulder and base are substantially round.

4. The container of claim 1 wherein the size of the secondary panels to the primary panels is selected from the ratio of 3:1, 2:1 or 7:5.

5. The container of claim 1, wherein the size of the secondary panels is 50% larger than the primary panels.

6. The container of claim 1, wherein the secondary panels comprise upper and lower panel walls.

7. The container of claim 6, wherein said secondary panels include at least one horizontal ribbing.

8. The container of claim 1, further comprising at least one recessed rib or groove between said sidewall and said shoulder portion and at least one recessed rib or groove between said sidewall and lower bottom portion.

9. The container of claim 8, wherein said recessed rib or groove is continuous along the circumference of the container.

10. The container of claim 1, further wherein the secondary panels are recessed with respect to the vertical transitional walls.

11. The container of claim 10, wherein upper and lower bumper walls extend continuously along the circumference of the container.

12. The container of claim 10, wherein upper and lower portions of said primary panel transition into said upper and lower bumper walls, respectively.

13. The container of claim 1, wherein said primary panels and said secondary panels are opposing.

14. The container of claim 13, wherein the panels are convex, substantially flat or concave shaped and become less convex, substantially flat or more concave after contraction.

15. The container of claim 13, wherein the secondary panels are convex and become less convex or substantially flat after contraction.

16. The container of claim 13, wherein the primary panels are substantially flat and become concave after contraction.

17. The container of claim 13, wherein the primary panels are convex and become concave after contraction.

18. The container of claim 13, wherein said primary panels are adapted for greater uptake of internal negative pressure than said secondary panels.

19. The container of claim 13, wherein the primary panels comprise an upper and lower portion.

20. The container of claim 13, further comprising horizontal transitional walls defining upper and lower portions of said primary panel.

21. The container of claim 20, wherein said horizontal transitional walls extend continuously along the circumference of the container.

22. A container comprising a plastic body having a neck portion defining an opening, connected to a shoulder portion extending downward and connecting to a sidewall extending downward and joining a bottom portion forming a base, said sidewall including at least a first and second pair of panels, wherein said first and second pair of panels are vacuum panels, and including vertical transitional walls disposed between and joining said first and second pair of panels, wherein said body is adapted to increase volume contraction and reduce pressure, and said first and second pair of panels are adapted to contract inwardly in response to internal negative pressure created during hot-fill processing and subsequent cooling of a hot liquid in said container; and further comprising upper and lower horizontal transitional walls, wherein the second pair of panels are recessed with respect to the upper and lower horizontal transitional walls; and wherein said second pair of panels include horizontal ribbings; and further wherein said second pair of panels are vertically concave.

23. The container of claim 22, wherein said second pair of panels include three horizontal ribbings.

24. A container comprising a plastic body having a neck portion defining an opening, connected to a shoulder portion extending downward and connecting to a sidewall extending downward and joining a bottom portion forming a base, said sidewall comprising more than two vacuum panels, and including vertical transitional walls disposed between and joining said more than two panels, wherein said body is adapted to increase volume contraction and reduce pressure, and said panels are adapted to contract inwardly in response to internal negative pressure created during hot-fill processing and subsequent cooling of a hot liquid in said container; and wherein at least two panels of said more than two vacuum panels are adapted for greater uptake of internal negative pressure than one other of said vacuum panels, further wherein said at least two panels are vertically concave.

* * * * *